US011643238B2

(12) United States Patent
Bohamed

(10) Patent No.: US 11,643,238 B2
(45) Date of Patent: May 9, 2023

(54) BOTTOM-FILL HYDRATION BOTTLE

(71) Applicant: Gary Bohamed, Valencia, CA (US)

(72) Inventor: Gary Bohamed, Valencia, CA (US)

(73) Assignee: Embo, LLC, Valencia, CA (US)

( * ) Notice: Subject to any disclaimer, the term of this patent is extended or adjusted under 35 U.S.C. 154(b) by 44 days.

(21) Appl. No.: 17/379,146

(22) Filed: Jul. 19, 2021

(65) Prior Publication Data

US 2022/0024630 A1 Jan. 27, 2022

Related U.S. Application Data

(60) Provisional application No. 63/055,429, filed on Jul. 23, 2020.

(51) Int. Cl.
*B65D 1/06* (2006.01)
*B65D 1/02* (2006.01)

(52) U.S. Cl.
CPC ..... *B65D 1/06* (2013.01); *B65D 1/0261* (2013.01)

(58) Field of Classification Search
CPC ..... B65D 1/06; B65D 1/0261; B65D 1/0223; B65D 11/08; B65D 51/1644; A47J 27/09; H01M 50/325
USPC ..... 215/378, 370, 11.4, 11.1, 311, 307; 220/601, 203.29; 222/568, 567, 566; 137/874, 872
See application file for complete search history.

(56) References Cited

U.S. PATENT DOCUMENTS 307,630 A * 11/1884 Clark ..... B65D 1/06 215/11.5
473,379 A * 4/1892 Browne ..... B65D 49/04 215/21
2,685,978 A * 8/1954 Crockett ..... B67D 1/0456 215/322
4,154,366 A * 5/1979 Acres ..... B65D 83/0055 222/386.5
2010/0237033 A1* 9/2010 Windmiller ..... B67C 3/2637 215/2
2021/0309408 A1* 10/2021 Dahl ..... B65D 1/0246

* cited by examiner

*Primary Examiner* — Robert J Hicks
(74) *Attorney, Agent, or Firm* — Jason T. Daniel, Esq.; Daniel Law Offices, P.A.

(57) ABSTRACT

A bottom-fill hydration bottle includes a main body having a valve assembly positioned along the bottom end. The valve assembly including an inlet opening, a valve, an outlet opening and a deflector. The deflector includes an input opening and at least one aperture that functions to discharge the received fluid in a direction that is different than the outlet opening of the valve. The hydration bottle includes a cap that is selectively coupled to the top of the main body. The cap includes a central spout having a bottom opening and an upper opening. A diffuser is positioned along the bottom opening of the spout. The diffuser including an output opening and at least one aperture that functions to receive fluid from the main body at an angle that is different from the bottom end of the spout.

12 Claims, 6 Drawing Sheets

BOTTOM-FILL HYDRATION BOTTLE

CROSS-REFERENCE TO RELATED APPLICATIONS

This application claims the benefit of U.S. Application Ser. No. 63/055,429 filed on Jul. 23, 2021, the contents of which are incorporated herein by reference.

TECHNICAL FIELD

The present invention relates generally to hydration bottles, and more particularly to a hydration bottle for receiving fluids from a bottom-feed system.

BACKGROUND

The statements in this section merely provide background information related to the present disclosure and may not constitute prior art.

It is common for participants of organized sporting events to be provided with water or other beverages for hydration during the contest. Whether the event is at the high school, college, or professional level, each team typically has one or more assistants who are responsible for providing beverages to the athletes.

Owing to the minimal facilities that are often available during outdoor events, the most common means for providing the beverages is through the use of refillable water bottles that are shared by everyone. In this regard, the bottles are typically filled by removing the cap and filling the topless bottle with a hose, igloo cooler/dispenser, or by physically dunking the bottle into a central cooler that contains a beverage. During this process, contaminants such as dirt, grass and other forms of debris located along the outside of the bottles and/or the assistants' hands are transferred into the beverage bottle top, igloo spigot and ultimately consumed by the players. Aside from exposing the players to illness, this cumbersome and slow process typically causes a significant portion of the beverage within the water bottle to become spilled before the assistant can replace the cap. As such, it is not uncommon for athletes to be handed a water bottle that is dirty and empty.

For this reason, there are known types of bottom-filling stations such as that described by U.S. patent application Ser. No. 17/103,512 to Embo, the contents of which are incorporated herein. When using these and other systems, it is necessary for the top of the bottle to have an opening/vent for allowing air to escape as the fluid is introduced within the bottle. Unfortunately, because the nozzle of such systems are oriented vertically and designed to force water upward at speed, it is not uncommon for the fluid to shoot through the inside of the bottle and escape out of the opening in the top of the bottle. When this occurs, nearby equipment and individuals can become wet, thus wasting the fluid and creating a mess.

Accordingly, the need exists for a bottom feed hydration bottle that does not suffer from the drawbacks described above.

SUMMARY OF THE INVENTION

The present invention is directed to a bottom-fill hydration bottle. One embodiment of the present invention can include a main body having a valve assembly positioned along a bottom end. The valve assembly including an inlet opening for engaging a filling station, a valve, and an outlet opening for discharging fluid into the main body.

In one embodiment, a deflector is positioned along the valve assembly within the main body of the bottle. The deflector including an input opening and at least one aperture that functions to discharge the received fluid in a direction that is different than the outlet opening of the valve.

In one embodiment, the hydration bottle includes a cap that is selectively coupled to the top of the main body. The cap can include a central spout having a bottom opening for receiving water from the main body and an upper opening for dispensing the fluid. In one embodiment, a diffuser is positioned along the bottom opening of the spout. The diffuser including an output opening and at least one aperture that functions to receive fluid from the main body at an angle that is different from the bottom end of the spout.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
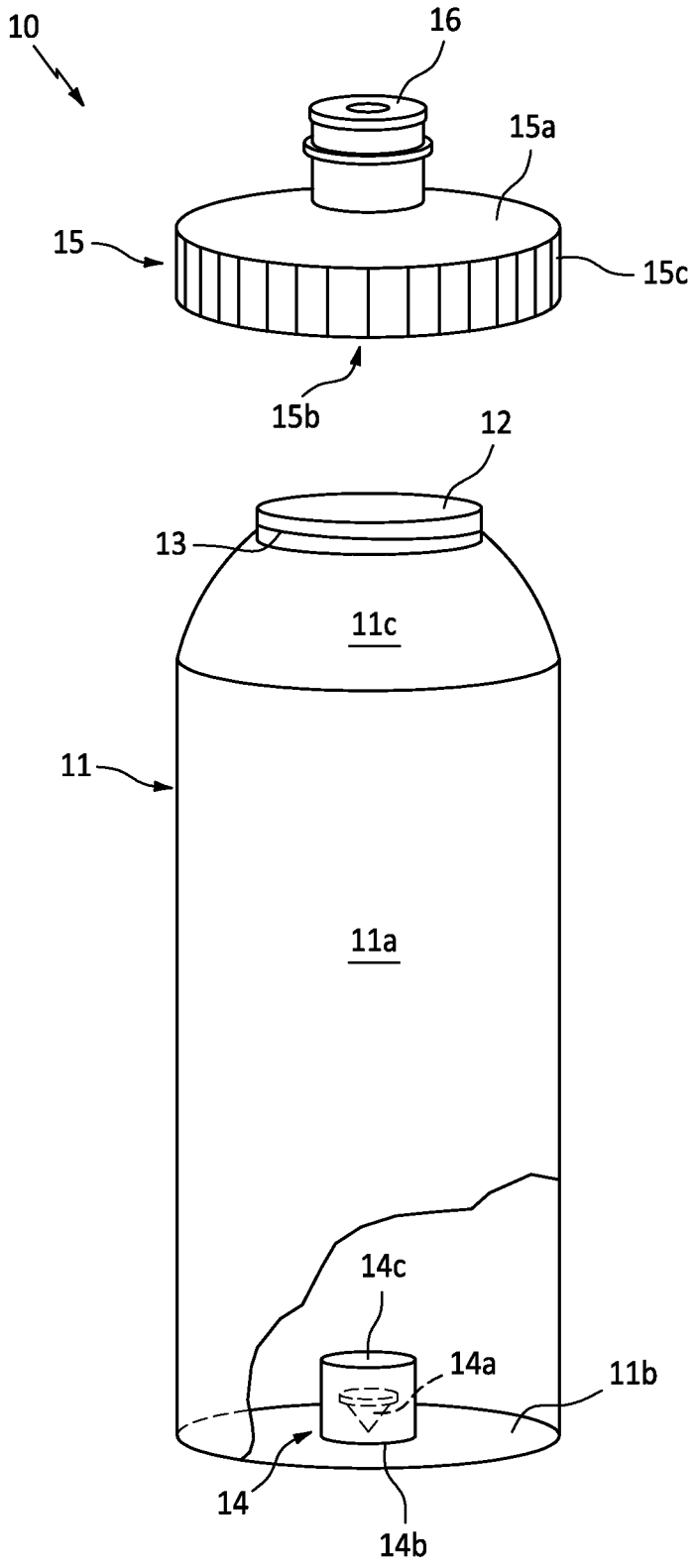
FIG. 1 is a front view of a bottom-fill hydration bottle that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described herein, a "unit" means a series of identified physical components which are linked together and/or function together to perform a specified function.

As described throughout this document, the term "about" "approximately" "substantially" and "generally" shall be used interchangeably to describe a feature, shape or measurement of a component within a tolerance such as, for example, manufacturing tolerances, measurement tolerances or the like.

As described herein, the term "removably secured," and derivatives thereof shall be used to describe a situation wherein two or more objects are joined together in a non-permanent manner so as to allow the same objects to be repeatedly joined and separated.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

FIGS. 1-6 illustrate one embodiment of a bottom-fill hydration bottle 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown in the drawings, the bottle 10 can include a main body, a valve assembly, a deflector, a cap and a diffuser.

As shown at FIG. 1, the main body 11 can include a continuous sidewall 11*a*, a bottom wall 11*b* and an opening 12 along the top 11*c* that form a hollow interior space. Threads 13 can be disposed along the opening for receiving a threaded cap as is known in the art. In the preferred embodiment, the main body will be constructed from a resilient plastic so as to allow a user to squeeze the sidewall to force liquid through the opening in the top of the bottle; however, the main body can be constructed from any number of other materials and can include any number of different shapes and sizes.

In one embodiment, a valve assembly 14 can be positioned along the bottom end 11*b* of the bottle and can function to receive fluid from the nozzle of a fluid dispenser. The valve assembly can include a one-way valve 14*a* that is positioned between an inlet opening 14*b* positioned along the outside of the bottle, and an outlet opening 14*c* positioned along the inside of the bottle.

In the preferred embodiment, the valve 14*a* can be constructed to comprise a resilient member that is biased in the closed position and that can be manually opened by insertion of the nozzle from the fluid dispenser. Likewise, the inlet opening 14*b* can include any number of different shapes and sizes suitable for engaging the filling spout of any type of liquid pumping device so as to receive liquids from any external device at any pressure level.

As shown, the bottle 10 can also include a hydration cap 15 having a top end 15*a*, a bottom end 15*b* and a sidewall 15*c* onto which a plurality of complementary threads (not illustrated) are located. A drinking spout 16 is provided along the cap 15.

In various embodiments, a deflector device can be provided along the inside of the bottle to change the direction of the fluid entering the bottle, and/or can be positioned along the cap itself. More specifically, the deflector or deflectors working together can function to prevent the fluid from shooting vertically upward from the valve outlet 14*c* to the top end of the bottle 11*c* where it can escape through the opening 12 and/or the spout 16.

Figure 2A:
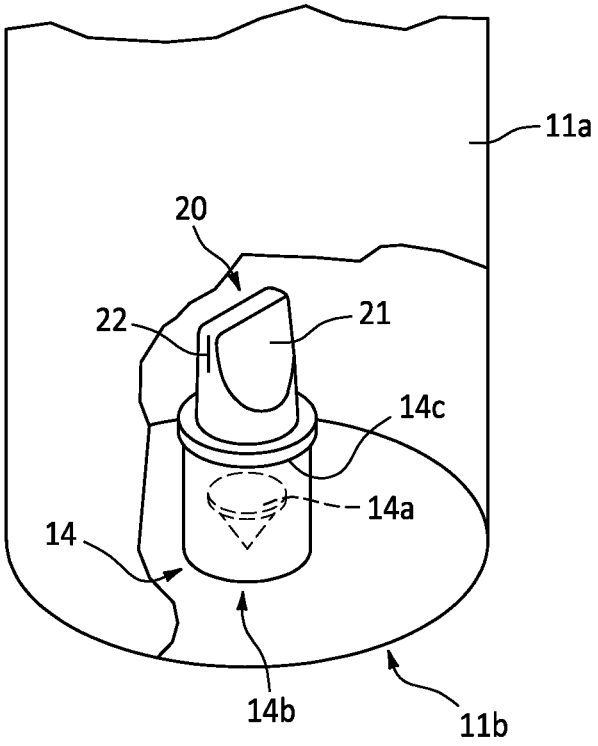
FIG. 2A is a cutout view of the bottom-fill hydration bottle in accordance with one embodiment of the invention.
Figure 2B:
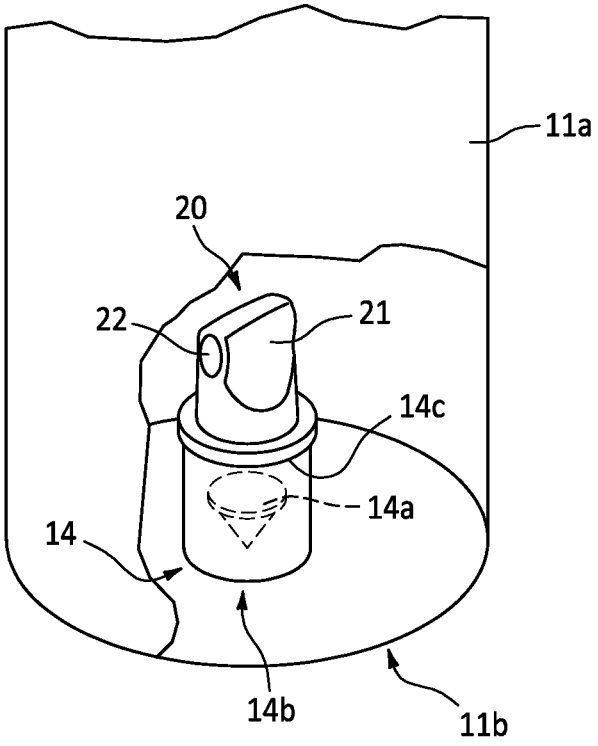
FIG. 2B is another cutout view of the bottom-fill hydration bottle in accordance with one embodiment of the invention.

FIGS. 2A and 2B illustrate one embodiment of a bottom-fill flow deflector 20 that includes, comprises, or consists of a generally hollow and resilient main body member 21 having a selectively openable aperture 22 along one side. The deflector can be connected to the valve 14 so as to receive fluid from the valve outlet opening 14*c* and direct the same toward the aperture 22. The deflector can be constructed such that the aperture 22 is biased in the closed position shown at FIG. 2A until receiving the fluid from the valve at a specific pressure such as 25 PSI, for example. Then, upon receiving the fluid at a sufficient pressure, the force of the fluid can function to move the aperture to the open position shown at FIG. 2B where it will flow into the bottle in a generally horizontal manner.

In the preferred embodiment, the deflector 20 can be constructed from a single piece of rubber or malleable plastic, however other construction materials are contemplated. In either instance, the aperture opening 22 can be oriented angularly (and preferably perpendicularly) to the inlet opening 14*b* of the valve to prevent the received liquids from entering the bottle in a vertical orientation.

Although described above with regard to a specific pressure and shape, this is for illustrative purposes only, as the deflector 20 can be constructed to include any number of different shapes and sizes and to discharge fluid at any number of different pressure levels. Moreover, although described above as a separate component that is secured along the top end of the valve 14, other embodiments are contemplated wherein the deflector 20 is formed as an integral part of the valve itself so as to include a unitary construction. In such an embodiment, the aperture 22 could function to eliminate the need for a separate valve component 14*a* in the assembly.

Figure 3:
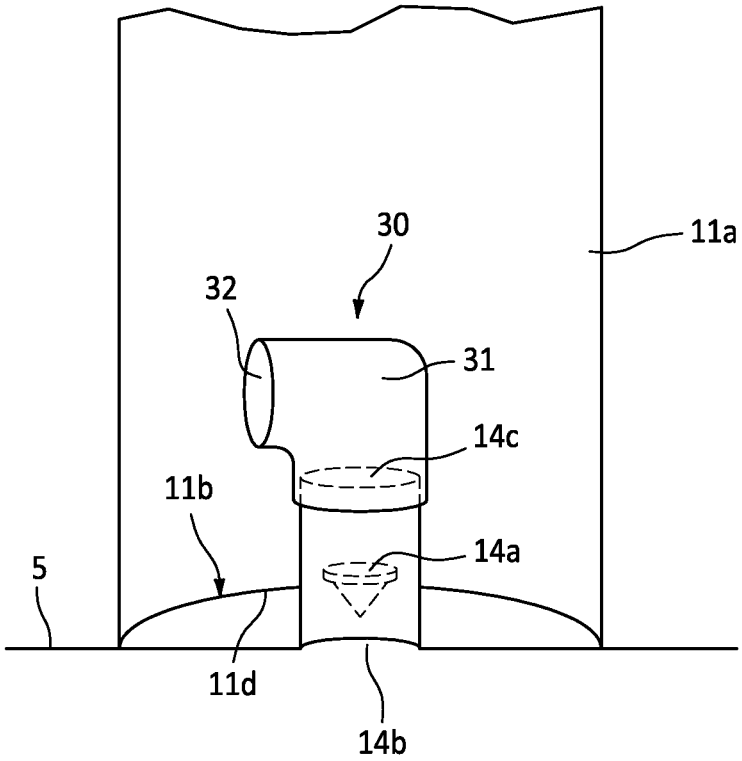
FIG. 3 is another cutout view of the bottom-fill hydration bottle in accordance with one embodiment of the invention.

FIG. 3 illustrates one embodiment of a bottom-fill flow deflector 30 that includes, comprises, or consists of a generally elbow-shaped member 31 having a fixed position aperture 32 along one side. The deflector can be connected to the valve 14 so as to receive fluid from the valve outlet opening 14*c* and direct the same toward the aperture 22 which is oriented 90 degrees relative to the valve outlet 14*c*. Such a feature functioning to change the flow of incoming fluid from a vertical orientation to a horizontal orientation.

Although described with regard to an elbow-shaped member having a single aperture, this is for illustrative purposes only, as many other shapes are also contemplated, each having at least one aperture that is oriented at a different angle than the valve outlet. Moreover, although described above as a separate component that is secured along the top end of the valve 14, other embodiments are contemplated wherein the deflector 30 is formed as an integral part of the valve itself so as to include a unitary construction.

Figure 4:
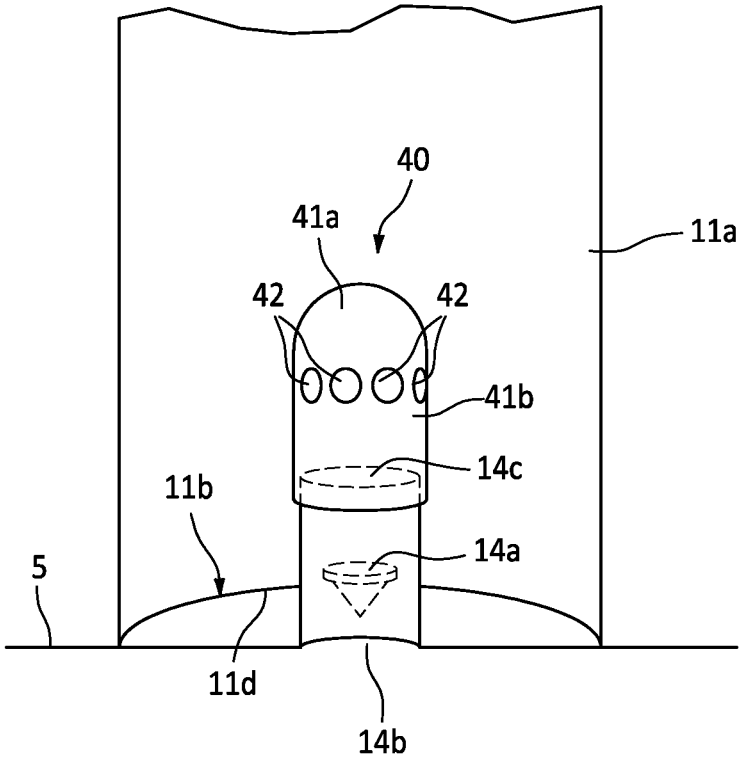
FIG. 4 is another cutout view of the bottom-fill hydration bottle in accordance with one embodiment of the invention.

FIG. 4 illustrates one embodiment of a bottom-fill flow deflector 40 that includes, comprises, or consists of a generally cylindrical-shaped member having a capped top end 41*a* and a continuous sidewall 41*b* with a plurality of apertures 42 thereon. The deflector can be connected to the valve 14 so as to receive fluid from the valve outlet opening 14*c* and direct the same toward the apertures 42 which are oriented 90 degrees relative to the valve outlet 14*c*. Such a feature functioning to change the flow of incoming fluid from a vertical orientation to a horizontal orientation.

Although described with regard to a cylindrical-shaped member having a plurality of apertures, this is for illustrative purposes only, as many other shapes are also contemplated, each having one or more apertures at any number of different locations and/or orientations relative to the valve outlet. Moreover, although described above as a separate component that is secured along the top end of the valve 14, other embodiments are contemplated wherein the deflector 30 is formed as an integral part of the valve itself so as to include a unitary construction.

In either instance, it is preferred that the outside facing portion of the bottom end of the bottle 11*b* be constructed to include a concave shape 11*d* so as to accommodate the material of the inlet opening 14*b* that is located positioned along the outside of the bottle. In this regard, the concavity will preferably include a central height that is equal to or greater than the height of the exposed portion of the valve relative to the outer edges of the bottom of the bottle 11. Such a feature ensuring the valve does not extend below the bottom edge of the bottle so as to allow the bottle to stand flush and upright when placed onto a flat surface 5 such as a countertop, for example.

Figure 5:
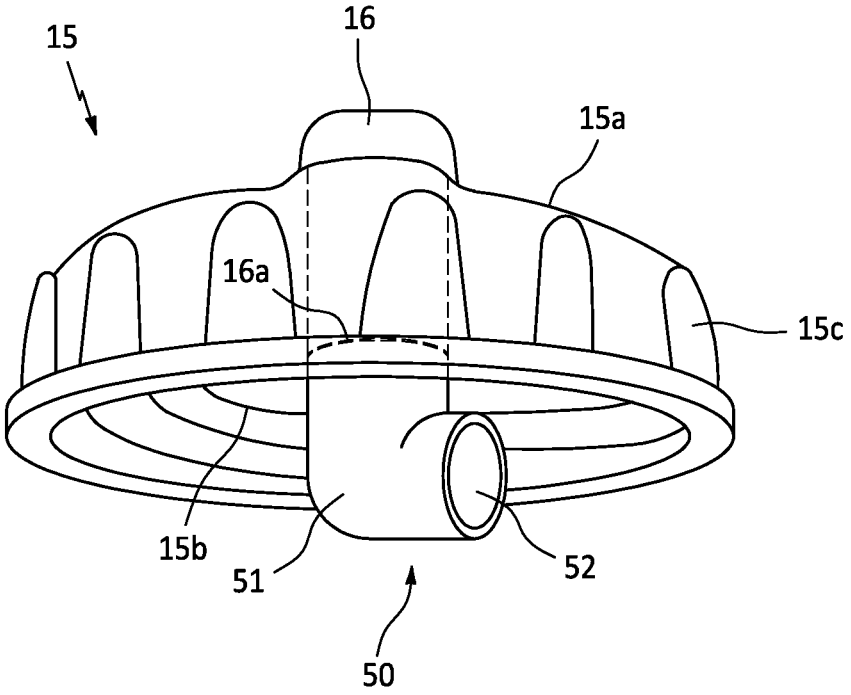
FIG. 5 is perspective view of the cap of the bottom-fill hydration bottle in accordance with one embodiment of the invention.

FIG. 5 illustrates one embodiment of the hydration cap 15 shown for use with the bottom-fill bottle such as that described above. As noted above, the cap includes a top end 15*a*, a bottom end 15*b*, a sidewall 15*c*, and a drinking spout 16 extending upward therefrom. In the illustrated embodiment, an angular diffuser 50 can be secured onto the bottom end of the cap 15*b* so as to be in communication with the spout inlet 16*a*.

As shown, the diffuser 50 can include, comprise, or consists of a generally elbow-shaped member 51 having a fixed position aperture 52 along one side. The diffuser can be connected to the spout 16 so as to allow fluid stored within the main body of the bottle 11 to enter through the aperture 52 and direct the same toward the spout opening 16*a* which is oriented 90 degrees relative to the aperture 52. Such a feature functioning to prevent liquids that enter the bottle 10 vertically from the valve 14 from being able to pass directly into the spout 16 and exit the same.

Although described with regard to an elbow-shaped member having a single aperture, this is for illustrative purposes only, as many other shapes are also contemplated, each having at least one aperture that is oriented at a different angle than the spout inlet. Moreover, although described above as a separate component that is secured along the bottom of the cap body, other embodiments are contemplated wherein the diffuser 50 is formed as an integral part of the cap itself so as to include a unitary construction.

Figure 6:
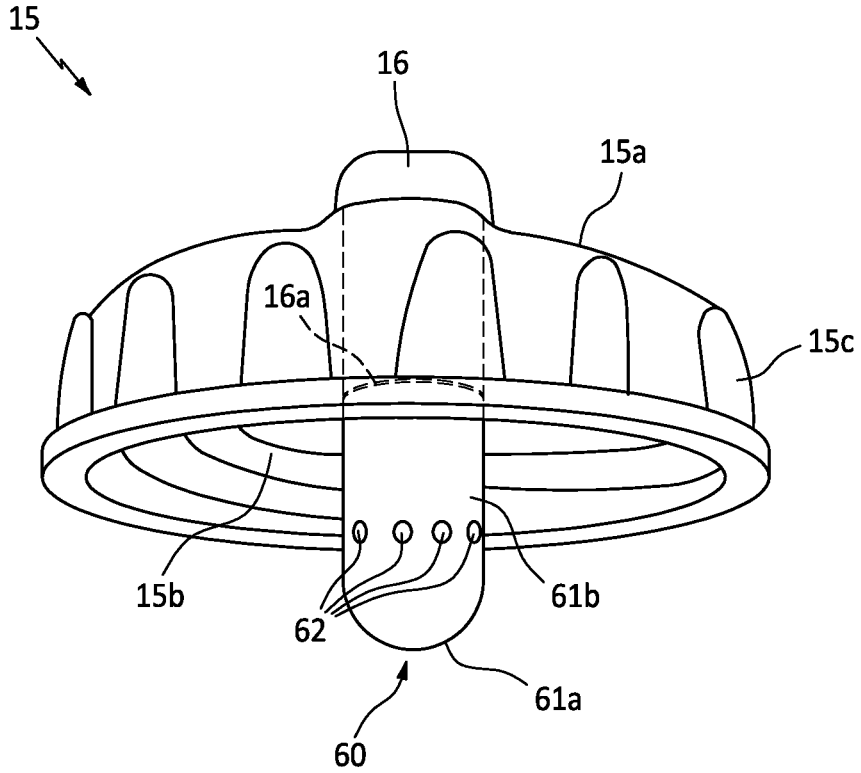
FIG. 6 is another perspective view of the cap of the bottom-fill hydration bottle in accordance with one embodiment of the invention.

FIG. 6 illustrates one embodiment of the hydration cap 15 shown for use with the bottom-fill bottle such as that described above. As noted above, the cap includes a top end 15*a*, a bottom end 15*b*, a sidewall 15*c*, and a drinking spout 16 extending upward therefrom. In the illustrated embodiment, an angular diffuser 60 can be secured onto the bottom end of the cap 15*b* so as to be in communication with the spout inlet 16*a*.

As shown, the diffuser 60 can include, comprise, or consist of a generally cylindrical-shaped member having a capped bottom end 61*a* and a continuous sidewall 61*b* with a plurality of apertures 62 thereon. The diffuser can be connected to the spout 16 so as to allow fluid stored within the bottle 11 to enter through the apertures 62 and direct the same toward the spout opening 16*a* which is oriented 90 degrees relative to the apertures 62. Such a feature functioning to prevent liquids that enter the bottle 11 vertically from the valve 14 from being able to pass directly into the spout 16 and exit the same.

Although described with regard to a cylindrical-shaped member having a plurality of apertures, this is for illustrative purposes only, as many other shapes are also contemplated, each having one or more apertures at any number of different locations and/or orientations relative to the spout inlet outlet. Moreover, although described above as a separate component that is secured along the bottom end of the cap 15, other embodiments are contemplated wherein the diffuser 60 is formed as an integral part of the cap itself so as to include a unitary construction.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A bottle, comprising:

a main body having a bottom end, a sidewall, a top end, an inside space, and an opening along the top end;

a valve assembly that is positioned along the bottom end of the main body, said valve having an inlet opening that is positioned along an outside surface of the bottle, a one way valve and an outlet opening that is positioned along the inside space of the main body;

a bottom-feed deflector that is positioned within the inside space of the main body, said deflector including functionality for changing a direction of a fluid exiting the outlet opening;

a cap that is selectively coupled to the top end of the main body; and a spout that is positioned along the cap, wherein the deflector includes an open first end that is in communication with the valve assembly, and wherein the deflector is constructed from a resilient and malleable material.

2. The bottle of claim 1, wherein the deflector includes at least one aperture that is separate from the open first end.

3. The bottle of claim 2, wherein each of the at least one aperture is positioned at an offset angle relative to the open first end of the deflector.

4. The bottle of claim 3, wherein the offset angle is 90 degrees.

5. The bottle of claim 1, further comprising a selectively openable aperture that is oriented perpendicular to the open first end.

6. The bottle of claim 5, wherein the aperture is configured to transition between an open position and a closed position upon receiving fluid at a predetermined pressure level.

7. The bottle of claim 1, wherein the deflector includes an elbow-shaped body.

8. The bottle of claim 7, wherein the elbow-shaped body includes a single aperture that is oriented perpendicular to an angle of the open first end.

9. The bottle of claim 1, wherein the deflector includes a cylindrical shaped body having a capped top surface, a sidewall, and a plurality of apertures disposed along the sidewall.

10. The bottle of claim 9, wherein each of the plurality of apertures are oriented perpendicular to the open first end.

11. The bottle of claim 1, wherein the valve and the deflector are discrete components.

12. The bottle of claim 1, wherein the valve and the deflector are constructed as a single component.

* * * * *